US006568029B1

(12) United States Patent
Letts

(10) Patent No.: US 6,568,029 B1
(45) Date of Patent: May 27, 2003

(54) BACK WASHING ASSEMBLY

(76) Inventor: Ronald G. Letts, 11341 Zola Ave., Pt Charlotte, FL (US) 33981

( * ) Notice: Subject to any disclaimer, the term of this patent is extended or adjusted under 35 U.S.C. 154(b) by 50 days.

(21) Appl. No.: 09/849,423

(22) Filed: May 4, 2001

(51) Int. Cl.[7] ..... B43L 21/00; A47K 7/02; A47L 13/46; A47L 13/10; A47L 25/00

(52) U.S. Cl. ..... 15/606; 15/244.1; 15/244.4; 15/210.1; 15/244.3

(58) Field of Search ..... 15/160, 210.1, 15/244.3, 244.4; 601/136; 4/606; D28/63

(56) References Cited

U.S. PATENT DOCUMENTS

| | | | | |
|---|---|---|---|---|
| 3,577,985 A | | 5/1971 | Guffin | |
| 5,311,635 A | | 5/1994 | Moore | |
| 5,628,083 A | | 5/1997 | Hayes | |
| 5,774,907 A | | 7/1998 | Doggwiler | |
| 5,784,722 A | | 7/1998 | Ureta et al. | |
| D403,119 S | | 12/1998 | Vazquez | |
| 5,857,235 A | * | 1/1999 | Morris | 219/497 |
| D409,337 S | * | 5/1999 | Johnson, Jr. | D28/63 |

OTHER PUBLICATIONS

Random House Unabridged Dictionary, 2nd Edition, p. 2000.*

Weisstein, Eric W., "Torus"1999, http://mathworld.wolfram.com/Torus.html.*

* cited by examiner

*Primary Examiner*—Robert J. Warden, Sr.
*Assistant Examiner*—Laura C Cole

(57) ABSTRACT

A back washing assembly for allowing the user to wash their back and other hard to reach areas with minimal effort. The back washing assembly includes a backing member designed for coupling to a shower wall, and a scrubbing portion coupled to the backing member such that the scrubbing portion faces outwardly from the shower wall, the scrubbing portion facilitates scrubbing portions of the users body.

1 Claim, 2 Drawing Sheets

BACK WASHING ASSEMBLY

BACKGROUND OF THE INVENTION

1. Field of the Invention

The present invention relates to back scrubbing devices and more particularly pertains to a new back washing assembly for allowing the user to wash their back and other hard to reach areas with minimal effort.

2. Description of the Prior Art

The use of back scrubbing devices is known in the prior art. More specifically, back scrubbing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,311,635; U.S. Pat. No. 3,577,985; U.S. Pat. No. Des. 403,119; U.S. Pat. No. 5,628,083; U.S. Pat. No. 5,784,722; and U.S. Pat. No. 5,774,907.

While these devices fulfill their respective, particular objectives and requirements, the aforementioned patents do not disclose a new back washing assembly. The inventive device includes a backing member designed for coupling to a shower wall, and a scrubbing portion coupled to the backing member such that the scrubbing portion faces outwardly from the shower wall, the scrubbing portion facilitates scrubbing portions of the users body.

In these respects, the back washing assembly according to the present invention substantially departs from the conventional concepts and designs of the prior art, and in so doing provides an apparatus primarily developed for the purpose of allowing the user to wash their back and other hard to reach areas with minimal effort.

SUMMARY OF THE INVENTION

In view of the foregoing disadvantages inherent in the known types of back scrubbing devices now present in the prior art, the present invention provides a new back washing assembly construction wherein the same can be utilized for allowing the user to wash their back and other hard to reach areas with minimal effort.

The general purpose of the present invention, which will be described subsequently in greater detail, is to provide a new back washing assembly apparatus and method which has many of the advantages of the back scrubbing devices mentioned heretofore and many novel features that result in a new back washing assembly which is not anticipated, rendered obvious, suggested, or even implied by any of the prior art back scrubbing devices, either alone or in any combination thereof.

To attain this, the present invention generally comprises a backing member designed for coupling to a shower wall, and a scrubbing portion coupled to the backing member such that the scrubbing portion faces outwardly from the shower wall, the scrubbing portion facilitates scrubbing portions of the users body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new back washing assembly apparatus and method which has many of the advantages of the back scrubbing devices mentioned heretofore and many novel features that result in a new back washing assembly which is not anticipated, rendered obvious, suggested, or even implied by any of the prior art back scrubbing devices, either alone or in any combination thereof.

It is another object of the present invention to provide a new back washing assembly which may be easily and efficiently manufactured and marketed.

It is a further object of the present invention to provide a new back washing assembly which is of a durable and reliable construction.

An even further object of the present invention is to provide a new back washing assembly which is susceptible of a low cost of manufacture with regard to both materials and labor, and which accordingly is then susceptible of low prices of sale to the consuming public, thereby making such back washing assembly economically available to the buying public.

Still yet another object of the present invention is to provide a new back washing assembly which provides in the apparatuses and methods of the prior art some of the advantages thereof, while simultaneously overcoming some of the disadvantages normally associated therewith.

Still another object of the present invention is to provide a new back washing assembly for allowing the user to wash their back and other hard to reach areas with minimal effort.

Yet another object of the present invention is to provide a new back washing assembly which includes a backing member designed for coupling to a shower wall, and a scrubbing portion coupled to the backing member such that the scrubbing portion facilitates scrubbing portions of the users body.

Still yet another object of the present invention is to provide a new back washing assembly that is easily adjustable for the height of multiple users.

Even still another object of the present invention is to provide a new back washing assembly that reduces the dependence of the physically impaired on others for assistance in bathing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
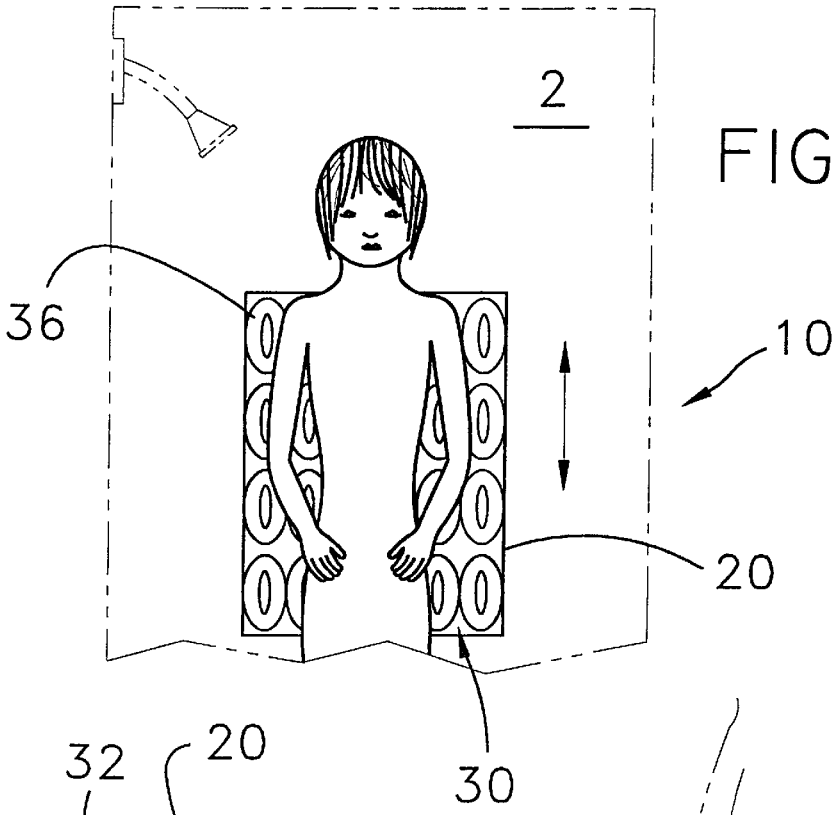
FIG. 1 is a schematic front view of a new back washing assembly according to the present invention.
Figure 5:
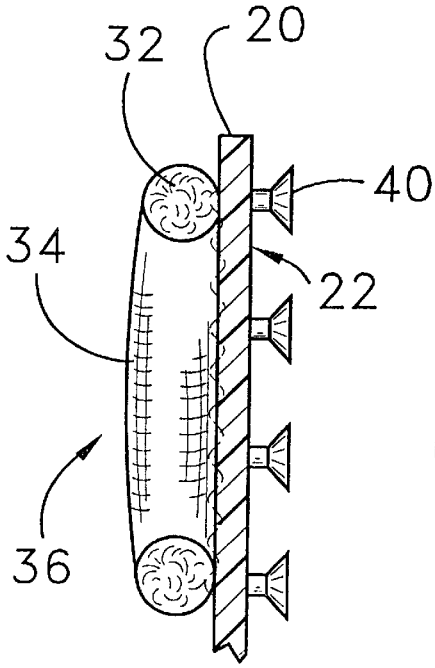
FIG. 5 is a schematic cross-sectional view of the present invention.
Figure 2:
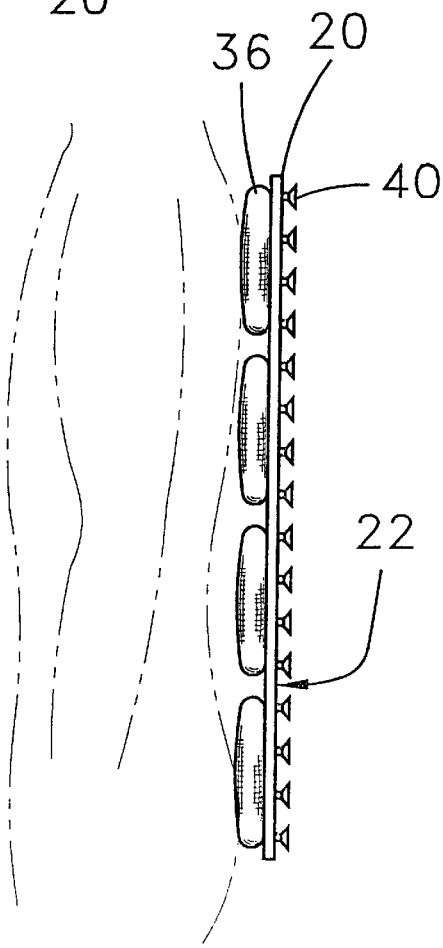
FIG. 2 is a schematic side view of the present invention in use.
Figure 4:
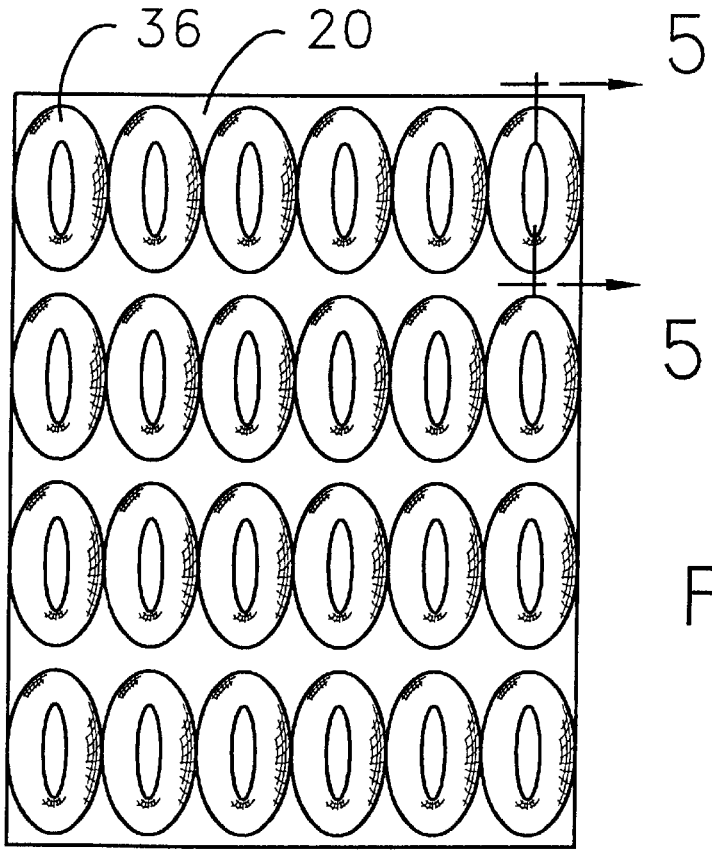
FIG. 4 is a schematic front view of the present invention.
Figure 3:
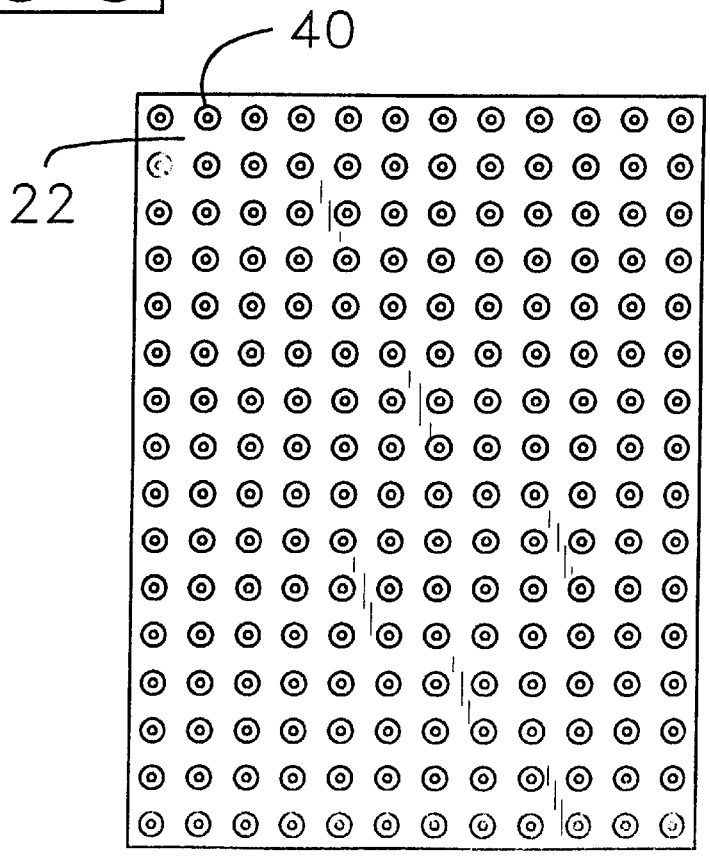
FIG. 3 is a schematic rear view of the present invention.

With reference now to the drawings, and in particular to FIGS. 1 through 5 thereof, a new back washing assembly embodying the principles and concepts of the present invention and generally designated by the reference numeral 10 will be described.

As best illustrated in FIGS. 1 through 5, the back washing assembly 10 generally comprises a backing member 20 and a scrubbing portion 30.

The backing member 20 is designed for coupling to a shower wall 2.

The scrubbing portion 30 is coupled to the backing member 20 such that the scrubbing portion 30 faces outwardly from the shower wall 2.

A plurality of suction cup members 40 is coupled to a back surface 22 of the backing member 20. Each one of the plurality of suction cup members 40 is designed for removably coupling the backing member 20 to the shower wall 2.

The scrubbing portion 30 further comprises a sponge portion 32 and a covering member 34. The sponge portion 32 is used for retaining and releasing liquids, such as water. The sponge portion 32 retains liquids by absorption. The sponge portion 32 releases liquids when a compressive force is applied to the sponge portion 32. The covering member 34 is a lattice and provides an abrasive 30 force when the user moves across a surface of the covering member 34. The covering member 34 is made of either nylon and rubber.

The scrubbing portion 34 further comprises a plurality of scrubbing pad members 36. Each of the scrubbing pad members 36 is coupled to the backing member 20 such that the plurality of scrubbing pad members 36 each face outward from the shower wall 2.

In an embodiment the plurality of scrubbing pad members 36 comprises 24 scrubbing pad members 36 positioned substantially in a spaced array of 6 scrubbing pad members 36 by 4 scrubbing pad members 36.

In a further embodiment each one of the plurality of scrubbing pad members 36 each have a shape that is generally toroidal (see, for example, FIG. 5) that is elongated in one direction (see, for example, FIGS. 1 and 5) so that the overall extent of each pad member is substantially elliptical.

In use, the back washing assembly is applied to a wall of a shower. The user then applies soap either to the scrubbing portion or onto a portion of the users body. The user then rubs against the scrubbing portion to clean the users back.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A back washing assembly for use in conventional showers and baths comprising:

a backing member adapted for coupling to a shower wall;

a scrubbing portion coupled to said backing member such that said scrubbing portion faces outwardly from the shower wall, said scrubbing portion being for facilitating scrubbing portions of the users body;

a plurality of suction cup members coupled to a back surface of said backing member, each one of said plurality of suction cup members being adapted for removably coupling said backing member to the shower wall;

said scrubbing portion further comprises:

a sponge portion for retaining and releasing liquids, said sponge portion retaining liquids by absorption, said sponge portion releasing liquids when a compressive force is applied to said sponge portion;

a covering member, said covering member being a lattice, said covering member providing an abrasive force when the user moves across a surface of said covering member;

said covering member comprises a material selected from the group consisting of nylon and rubber;

said scrubbing portion further comprises a plurality of scrubbing pad members coupled to said backing member such that said plurality of scrubbing pad members each face outwardly from the shower wall, each of said scrubbing pad members being substantially toroidal in shape and being elongated in one direction to form an elliptical extent such that said scrubbing pad members are adapted for fitting around protruding areas of the user to scrub areas of the back of the user not easily reached; and wherein said plurality of scrubbing pad members comprises 24 scrubbing pad members positioned substantially in a spaced array of 6 scrubbing pad members by 4 scrubbing pad members.

* * * * *